US006739001B2

(12) United States Patent
Flick et al.

(10) Patent No.: US 6,739,001 B2
(45) Date of Patent: May 25, 2004

(54) CUSHIONING DEVICE INCLUDING A RESTRAINT STRUCTURE

(75) Inventors: Roland E. Flick, Elma, NY (US); Gregory J. Pepe, Lancaster, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 50 days.

(21) Appl. No.: 10/134,341

(22) Filed: Apr. 26, 2002

(65) Prior Publication Data

US 2002/0170117 A1 Nov. 21, 2002

Related U.S. Application Data

(60) Provisional application No. 60/287,111, filed on Apr. 27, 2001.

(51) Int. Cl.[7] ..... A47C 21/08

(52) U.S. Cl. ..... 5/425; 5/732; 5/710; 5/706

(58) Field of Search ..... 5/691, 714, 712, 5/706, 707, 709, 424, 425

(56) References Cited

U.S. PATENT DOCUMENTS 3,148,387 A * 9/1964 Sarnie, Jr. et al. ..... 5/632
4,234,982 A * 11/1980 Bez et al. ..... 5/702

(List continued on next page.)

FOREIGN PATENT DOCUMENTS

| | | |
|---|---|---|
| EP | 0 558 713 | 3/1998 |
| GB | 2 346 809 | 4/2002 |
| JP | 6503438 | 8/1992 |

*Primary Examiner*—Teri Pham Luu
(74) *Attorney, Agent, or Firm*—Roach, Brown, McCarthy & Gruber, P.C.; Kevin D. McCarthy

(57) ABSTRACT

The present invention relates to a cushioning device including an inflatable cushion having at least one side and first and second opposing surfaces, and at least one restraint structure attached to at least a portion of the at least one side of the inflatable cushion.

21 Claims, 4 Drawing Sheets

U.S. PATENT DOCUMENTS 4,286,344 A * 9/1981 Ikeda ..... 5/717
4,454,615 A 6/1984 Whitney
4,483,030 A 11/1984 Flick et al.
4,621,382 A * 11/1986 Burriss et al. ..... 5/625
4,860,397 A 8/1989 Gusakov
4,872,228 A * 10/1989 Bishop ..... 5/425
4,934,002 A * 6/1990 Watanabe ..... 5/607
4,945,588 A 8/1990 Cassidy et al.
4,969,459 A 11/1990 Gusakov
4,980,940 A * 1/1991 Isshiki ..... 5/724
5,068,935 A 12/1991 Hagopian
5,072,468 A 12/1991 Hagopian
5,109,165 A 4/1992 Gusakov
5,140,309 A 8/1992 Gusakov
5,183,039 A 2/1993 Sarian et al.
5,184,112 A 2/1993 Gusakov
5,237,501 A 8/1993 Gusakov
D343,531 S 1/1994 Hagopian
D351,071 S 10/1994 Hagopian
D368,525 S 4/1996 Karten et al.
5,745,939 A 5/1998 Flick et al.
5,787,531 A 8/1998 Pepe
5,794,289 A 8/1998 Wortman et al.
5,875,282 A 2/1999 Jordan et al.
5,890,245 A * 4/1999 Klearman et al. ..... 5/714
5,901,393 A 5/1999 Pepe et al.
5,926,883 A 7/1999 Rechin et al.
5,957,872 A 9/1999 Flick
6,061,855 A 5/2000 Flick
6,073,291 A * 6/2000 Davis ..... 5/711
6,079,070 A 6/2000 Flick
6,099,951 A 8/2000 Flick et al.
6,131,469 A 10/2000 Wortman et al.
6,145,142 A 11/2000 Rechin et al.
6,152,169 A 11/2000 Flick
6,200,284 B1 3/2001 Flick
6,357,491 B1 3/2002 Buchanan et al.
6,375,633 B1 4/2002 Endress et al.
6,447,865 B1 9/2002 Flick et al.
6,488,043 B2 12/2002 Flick
6,517,510 B1 2/2003 Stewart et al.
2002/0151243 A1 10/2002 Flick et al.
2002/0187332 A1 12/2002 Flick et al.
2003/0028135 A1 2/2003 Flick et al.
2003/0028157 A1 2/2003 Jusiak et al.

* cited by examiner

CUSHIONING DEVICE INCLUDING A RESTRAINT STRUCTURE

The present invention claims benefit of U.S. Provisional Patent Application Serial No. 60/287,111, filed Apr. 27, 2001, which is hereby incorporated by reference in its entirety.

FIELD OF THE INVENTION

The present invention relates to a cushioning device, such as an overlay for a mattress, which includes an integrated restraint structure.

BACKGROUND OF THE INVENTION

Therapeutic supports for bedridden patients have been well known for many years. Such therapeutic supports include inflatable mattresses and cushions, as well as a variety of foam mattresses and cushions. Most therapeutic mattresses and cushions are designed to reduce "interface pressures," which are the pressures encountered between the mattress and the skin of a patient lying on the mattress. It is well known that interface pressures can significantly affect the well-being of immobile patients in that higher interface pressures can reduce local blood circulation, tending to cause bed sores and other complications. With inflatable mattresses, such interface pressures depend (in part) on the air pressure within the inflatable support cushions. Most inflatable therapeutic mattresses are designed to maintain a desired air volume within the inflated cushion or cushions to prevent bottoming. "Bottoming" refers to any state where the upper surface of any given cushion is depressed to a point that it contacts the lower surface, thereby markedly increasing the interface pressure where the two surfaces contact each other.

One type of therapeutic support is an inflatable cushion used as an overlay (i.e., a supplemental pad positioned on top of an existing structure, such as a mattress). For example, the Sof-Care® cushions of Gaymar Industries, Inc. are cushions which overlay an existing mattress and which include a multitude of lower individual air chambers and a multitude of upper individual air chambers with air transfer channels therebetween. Air is transferred through the interconnecting channels to redistribute the patient's weight over the entire bed cushion. A three layer overlay cushion known as the Sof-Care® II cushion continually redistributes patient weight through more than 300 air-filled chambers and may include hand grips at the side of the cushion to assist in patient positioning. In these types of cushions, the individual air chambers remain pressurized.

There have also been provided cushion and pump combinations in which alternate air chambers are alternately inflated and deflated to relieve excess pressure on patients at risk of developing pressure ulcers or to relieve excess pressure on patients with pressure ulcers (e.g., the Airflo Alternating Pressure System of Gaymar Industries, Inc.). Micro-vents and/or low air loss tubes may also provided to produce a gentle flow of air beneath the patient to help minimize moisture build-up.

Rotating the patient on an inflatable mattress is also a well known method to avoid bed sores on immobile patients. Such a method is disclosed, for example, in U.S. Pat. Nos. 5,794,289 and 6,079,070, which are commonly assigned.

U.S. Pat. No. 5,794,289 to Wortman et al. describes a mattress unit having a plurality of air cells. The mattress unit rotates a patient by controlling the air pressure in each air cell by inflation and deflation. To rotate a patient to its right side requires deflating the right air cells and inflating the left air cells. The air pressure required to rotate the patient depends on the patient's weight, body type, and various other parameters.

U.S. Pat. No. 6,079,070 to Flick describes a cushion for use as an overlay that includes a pair of inflatable side-by-side upper cells, a pair of individually inflatable side-by-side lower bladders, a crib, and a manifold all disposed within a cover. For inclining the cushion upper surface to one side, one of the bladders is inflated while the other is uninflated.

However, when the overlay cushions described above are used in conjunction with an underlying structure, e.g., a separate mattress unit, the risk to the user of falling from the structure is increased. In particular, the overlay cushion adds to the height of the structure, thus increasing the risk. Moreover, the risk of falling from the structure is especially prevalent when an overlay cushion is used as part of a rotating mattress. In this situation, the weight of the user is being shifted toward one side of the mattress and, therefore, the risk of falling from the mattress in that direction is significantly increased. Since those users requiring a rotating mattress are typically unable to move well themselves, the added risk to these users is intensified.

One attempt to resolve the above-described risk of falling is the crib structure in U.S. Pat. No. 6,079,070 to Flick. In particular, in U.S. Pat. No. 6,079,070, the cushioning system includes a crib structure which provides a framework for receiving the inflatable portion of the cushioning system. The crib has two protruding leg covers and a base connecting the two leg covers extending beneath the inflatable portion of the cushion. The leg covers extend along the outer sides of the inflatable portion and receive bolster bladders. Alternatively, the crib structure may be composed of foam material.

Thus, the cushioning system disclosed in U.S. Pat. No. 6,079,070 is a multi-component system including two major components, an inflatable portion and a supporting crib. Each of these major components includes several sub-components, all of which must be placed within a cover. Therefore, this cushioning system requires on-site assembly, making it more difficult to use by untrained users, or must be delivered pre-assembled, which would require expensive and bulky packaging. Moreover, the production of a multi-component cushioning system increases manufacturing difficulties and costs.

Accordingly, there remains a need for a cushioning device for use as an overlay which includes an inexpensive and easy to use restraint system. The present invention is directed to overcoming these and other deficiencies in the art.

SUMMARY OF THE INVENTION

The present invention relates to a cushioning device including an inflatable cushion having at least one side and first and second opposing surfaces, and at least one restraint structure attached to at least a portion of the at least one side of the inflatable cushion.

The present invention also relates to a cushioning system including an inflatable cushion having at least one side and first and second opposing surfaces, at least one restraint structure attached to at least a portion of the at least one side of the inflatable cushion, and an inflation device operably connected to the inflatable cushion.

The present invention also relates to a method for restraining a user on a cushion. This method involves positioning a cushioning device on a supporting structure, the cushioning device including an inflatable cushion having at least one side and first and second opposing surfaces, and at least one restraint structure attached to at least a portion of the at least one side of the inflatable cushion. Then, a user is positioned on first surface of the inflatable cushion, and the inflatable cushion is inflated.

The cushioning device of the present invention provides a simple, one-piece device for home or hospital use for providing pressure relief so that pressure ulcers may be eliminated or retarded. The integrated restraint structure in the cushioning device eliminates the need for multiple components, thereby eliminating the need for on-site assembly of the cushioning device. In addition, the elimination of the need for multiple components in the cushioning device makes the device easy to use for an untrained user. Further, the integrated restraint structure in the cushioning device decreases costs of manufacture.

DETAILED DESCRIPTION OF THE INVENTION

Figure 1:
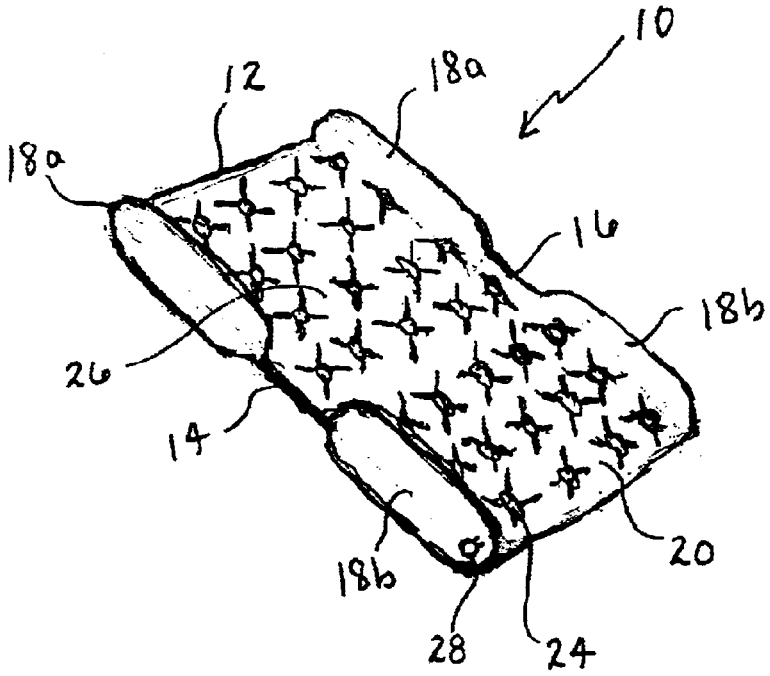
FIG. 1 is a perspective view of a cushioning device in accordance with a first embodiment of the present invention.
Figure 2:
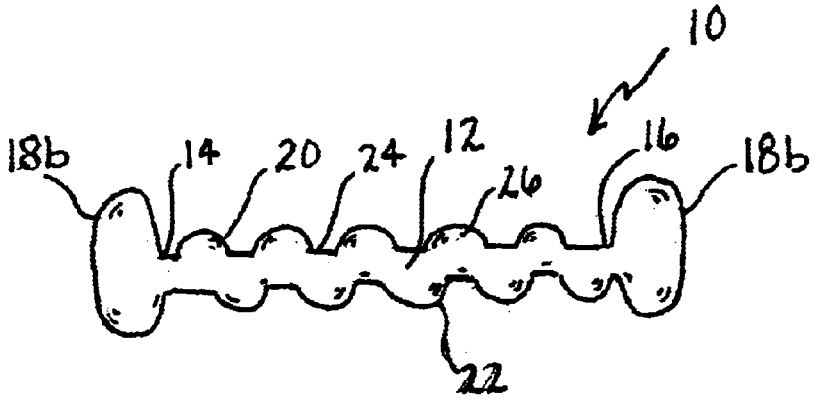
FIG. 2 is a cross-sectional view of the cushioning device of FIG. 1.

A cushioning device in accordance with one embodiment of the present invention is shown in FIGS. 1–2. The cushioning device 10 includes a cushioning section 12, which supports the user and provides pressure relief to the user so that the development of pressure ulcers is prevented or retarded. The cushioning section includes first and second sides 14 and 16. The cushion also includes restraint structures 18*a* and 18*b* which are attached to at least a portion of the first and second sides 14 and 16 of the cushioning section 12. The cushioning device 10 is a simple, one-piece device for home or hospital use which eliminates the need for on-site assembly, thereby making the cushioning device 10 easy to use for an untrained user. Further, the integrated (i.e., attached to the cushioning section) restraint structures 18*a*, 18*b* in the cushioning device 10 decrease costs of manufacture.

In this particular embodiment, as shown in FIGS. 1 and 2, the cushioning section 12 is an inflatable bladder having a first surface 20 and an opposing second surface 22 (i.e., the cushioning section 12 is capable of being filled with a fluid). The bladder is made of three layers of suitable puncture-resistant vinyl film or other suitable air impervious flexible material. However, the bladder may be made of two layers of air impervious flexible material, if desired.

The bladder has a plurality of button welds, illustrated at 24, to prevent ballooning of the bladder. The button welds 24 produce an upper layer and a lower layer of a plurality of interconnected cells 26 in the cushioning section 12. Such upper and lower layer bladder systems are shown, for example, in U.S. Pat. No. 5,794,289, which is hereby incorporated by reference in its entirety. The number of cells 26 in the cushioning section 12 may vary, however, suitable numbers of cells 26 include from about 150 to about 300 cells. As the cells 26 exchange air or any other suitable medium, the user's weight is redistributed over the entire cushioning section 12. The cushioning section may have a height when inflated of about 3½ inches. However, the height of the cushioning section 12 may be varied as desired. The cushioning device 10 includes at the foot end a connector 28 for receiving air from an inlet hose as described with regard to FIG. 5. However, the connector 28 may be placed at any position on the cushioning device 10.

In an alternative embodiment, the cushioning section 12 may be comprised of multiple side-by-side bladders which may be attached to each other, for example, by heat welding.

In another embodiment of the present invention, the cushioning section 12 may include a plurality of pin holes or micro-vents in its first surface 20 to produce a gentle flow of air beneath the user and to minimize moisture build-up.

In yet another alternative embodiment of the present invention, the cushioning section 12 may be of the alternating pressure type, i.e., it has at least two series of alternating cells, which are alternately inflated and deflated, one series of cells being inflated while the other series of cells is deflated. Such alternating pressure type cushions are disclosed, for example, in U.S. Pat. Nos. 5,794,289 and 5,901,393, which are hereby incorporated by reference in their entirety.

In a further embodiment of the present invention, the cushioning section 12 may include a device for measuring the internal pressure of the cushioning section 12. Typically, such devices activate a light when the internal pressure of the cushioning section 12 is below a certain level, indicating a bottoming condition. The device may be integrated into the valve through which fluid is being fed into the cushioning section 12. Such devices are well known in the art and are described, for example, in U.S. Pat. No. 5,140,309, which is hereby incorporated by reference in its entirety.

In this particular embodiment, the restraint structures comprise a head-end section 18*a* and a foot end section 18*b*.

However, the restraint structures 18*a* and 18*b* could include any number of sections extending along the length of the first and second sides 14, 16 of the cushioning section 12. In an alternative embodiment, the restraint structures could extend the full length of the first and second sides 14, 16 of the cushioning section 12 to form a single restraint structure attached to each side 14, 16 (see, e.g., FIG. 3). In yet another embodiment, the restraint structures could extend only partially long the first and second sides 14, 16 of the cushioning section 12. For example, the restraint structures could include only a head-end portion 18*a* or only a foot end portion 18*b*. The restraint structures 18*a* and 18*b* help restrain the user on the cushioning device by providing a structure to reduce the risk that the user will accidentally fall from the cushioning device.

As shown in FIGS. 1 and 2, in this embodiment of the present invention the restraint structures 18*a* and 18*b* are interconnected (i.e., in fluid communication) with the cushioning section 12 through at least one air channel (or other inflation medium transfer channel) and, therefore, are inflated with the cushioning section 12 of the cushioning device 10. In this particular embodiment, the restraint structures 18*a* and 18*b* extend above and below the first and second surfaces 20, 22 of the cushioning section 12 to restrain the user. However, the restraint structures 18*a* and 18*b* may extend beyond the cushioning section 12 in only one dimension, for example, only above the first surface 20 of the cushioning section 12. The restraint structures 18*a* and 18*b* typically extend about one to about three inches above and/or below the first and second surfaces 20, 22 of the cushioning section, however, any desirable height may be used. Any suitable shape for the restraint structures may be used, for example, generally oval in cross-section, generally rectangular in cross-section, or generally circular in cross-section.

In this embodiment of the present invention, the restraint structures 18*a* and 18*b* are provided at the same pressure as the cushioning section 12 (i.e., provide the same level of support). Such pressures are determined by the user of the cushioning device 10, but preferably provide an interface pressure of less than about 32 mmHg.

Figure 3:
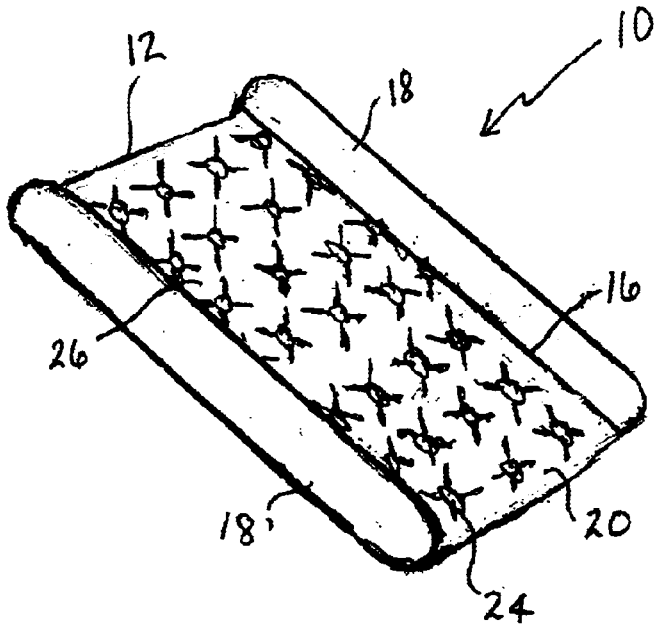
FIG. 3 is a perspective view of a cushioning device in accordance with a second embodiment of the present invention.
Figure 4:
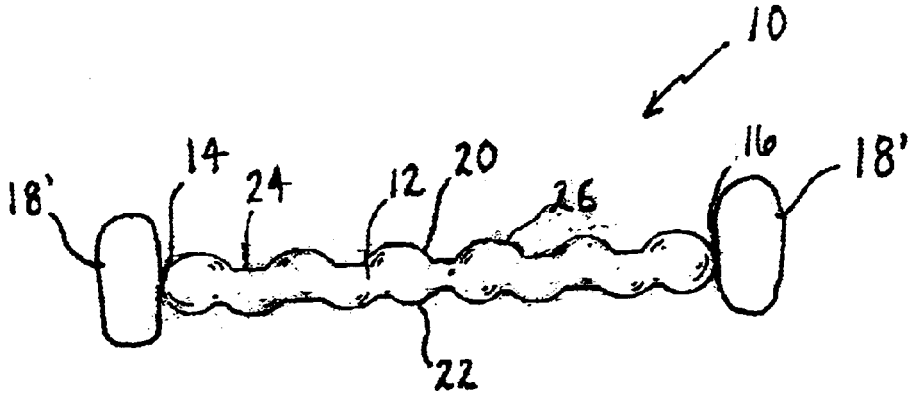
FIG. 4 is a cross-sectional view of the cushioning device of FIG. 4.

A second embodiment of the cushioning device 10 of present invention is shown in FIGS. 3 and 4. This embodiment of the present invention is identical to the previously described embodiment, except as described below. In this embodiment of the present invention, restraint structures 18' are attached to the first and second sides 14, 16 of the cushioning section 12 but are not interconnected with the cushioning section 12. In particular, the restraint structures 18' are strip heat welded to the first and second sides 14, 16 of the cushioning section 12 and form separate inflatable sections. However, any suitable attachment device may be used to attach restraint structures 18' to the first and second sides 14, 16 of the cushioning section 12, including, but not limited to, adhesives, stitching, and heat seals.

In this particular embodiment, the restraint structures 18' extend above and below the first and second surfaces 20, 22 of the cushioning section 12. However, in an alternative embodiment, the restraint structures 18' may extend only above the first surface 20 of the cushioning section 12.

In this embodiment of the present invention, the restraint structures 18' are provided at the same pressure as the cushioning section 12 and extend the entire length of first and second sides 14, 16.

In an alternative embodiment of the present invention, the restraint structures 18' are provided at a greater pressure than the cushioning section 12. The desired pressure in the restraint structures 18' will vary depending upon the user, however, suitable pressures include pressures from about 10 to about 20 mmHg greater than the cushioning section 12. The use of increased pressure in the restraint structures allows the restraint structures to provide a more firm and unyielding barrier for restraint of the user.

In this embodiment of the present invention, to produce increased pressure in the restraint structures 18', as compared to the cushioning section 12, separate valves which are connected to an inflation device, as described below, may be provided for the cushioning section 12 and the restraint structures 18'. The separate valves may be used to separately control the pressure provided by the cushioning section 12 and the restraint structures 18'.

Although the restraint structures 18*a*, 18*b* and 18' of the present invention are inflatable restraints, other non-inflatable restraint structures may be used. For example, restraint structures 18*a*, 18*b* and 18' may be formed of foam, foam beads, gels, batting, or other suitable materials for restraining a user.

Figure 5:
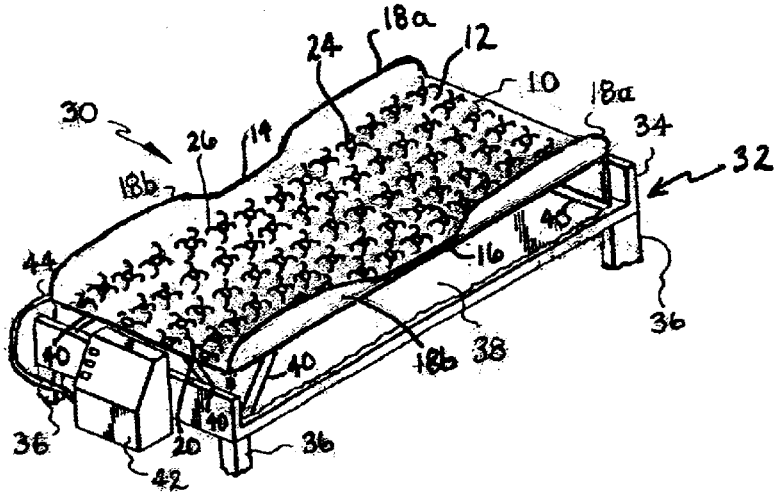
FIG. 5 is a perspective view of a bed including a cushioning device in accordance with a first embodiment of the present invention.

Referring to FIG. 5, a cushioning system 30 is shown. The cushioning system 30 includes a bed 32 having a frame 34, a plurality of legs 36, and a support structure 38, which, in this particular embodiment, is a conventional box spring. The box spring 38 has a first, substantially planar surface (shown in FIGS. 6–8) and a second substantially planar surface (not shown). The first, substantially planar surface of the box spring is adjacent and in contact with the second surface 22 of the cushioning device 10 of the present invention. The cushion includes a first surface 20 on which a user may rest. The cushion 10 may be used, for example, in a hospital or home health care setting. The box spring 38 and cushion 10 are held together by any suitable device, such as forward and rear straps 40. The forward and rear straps 40 extend under the corners of the box spring 38. However, the forward and rear straps 40 may extend under the box spring 38 from opposite sides and may attach to each other by suitable attachment devices, such as hook and loop fasteners and adhesives. A cover may be provided over the cushion 10 and predetermined portions of box spring 38, although it is not required. If a cover is used, the cover is preferably composed of an elastomeric material, which is stretchable and minimizes a "hammocking" effect that interferes with the effectiveness of the inflatable structure.

In this embodiment, as shown in FIG. 5, a conventional pump 42 supplies air or other suitable pressurizing medium to the cushioning device 10, including the cushioning section 12 and the restraint structures 18*a* and 18*b*. The pump 42 has a pair of hooks (not shown) for suitably hooking onto the frame 34 at the foot end of the bed 32 and automatically maintains a desired pressure in the cushioning section 12 and restraint structures 18*a* and 18*b*. The air is directed into the cushioning device 10 through hose 44. If the cushioning device 10 includes restraint structures 18', which are not interconnected with the cushioning section 12, a second hose is provided to direct air into the restraint structures 18', wherein both hoses (i.e., outlet hoses) are connected to a manifold (not shown) which receives air from the pump 42. In this particular embodiment, a pump 42 is used, however, other suitable inflation devices could be used, including, but not limited to, blowers. Where the restraint structures 18' are not interconnected with the cushioning section 12, a second inflation device could also be used, if desired.

Although the support structure 38 depicted in FIG. 5 is a box spring, any suitable type of support structure may be used. For example, other suitable support structures include, but are not limited to, mattresses, chairs, and wheelchairs. The cushioning device 10 is suitably shaped (e.g., rectangular, square, oval, or circular) and sized to be received by a desired portion of the support structure.

Figure 6:
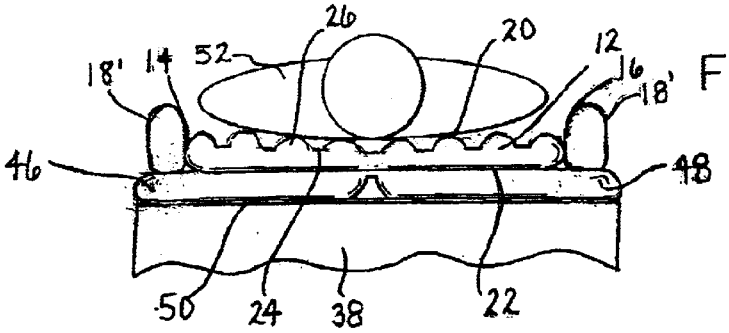
FIG. 6 is an end view of a cushioning device in accordance with a third embodiment of the present invention.
Figure 7:
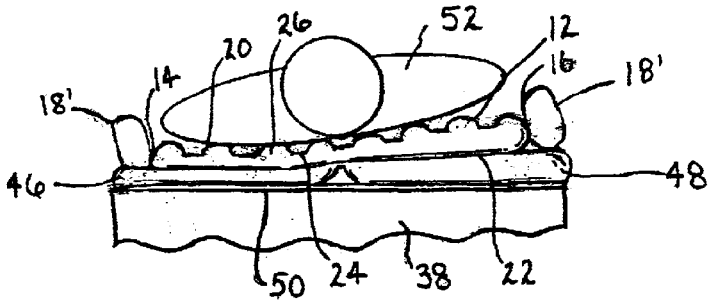
FIG. 7 is an end view of the cushioning device of FIG. 6 inclined so that the user's right side is raised.
Figure 8:
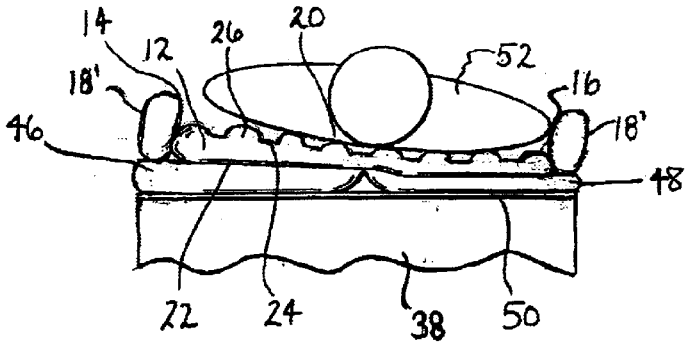
FIG. 8 is an end view of the cushioning device of FIG. 6 inclined so that the user's left side is raised.

A third embodiment of a cushioning device 10 in accordance with the present invention is shown in FIGS. 6–8. This embodiment of the present invention is identical to the previously described second embodiment of the present invention, except as described below.

The cushioning device 10 shown in FIGS. 6–8 further includes first and second inflatable bladders 46, 48, which are positioned in between the second surface 22 of the cushioning section 12 and a first, substantially planar surface 50 of the support structure 38. The first and second inflatable bladders 46, 48 are side-by-side bladders which extend lengthwise, i.e., from a head end to a foot end of the cushioning device 10 beneath cushioning section 12 and restraint structures 18'. In this particular embodiment, a single cushioning section 12 is provided over the bladders 46, 48, however, multiple cushioning sections could be used (for example, two side-by-side cushioning sections, each overlying a bladder, could be used). The first and second inflatable bladders 46, 48 each include a connector (not shown) for receiving air from inlet hoses (not shown) which are connected to pump 42 (shown and described in FIG. 5).

The first and second inflatable bladders 46, 48 are made of suitable puncture-resistant vinyl film or other suitable air impervious flexible material. The bladders 46, 48 are suitably formed to be strip heat welded together utilizing principles commonly known to those of ordinary skill in the art to which this invention pertains. However, alternative techniques for attaching the first and second inflatable bladders 46, 48 may be used. The first and second inflatable bladders 46, 48 may be formed with notches to provide greater lifting force to the shoulders, chest, and abdomen areas of the user, as described, for example, in U.S. Pat. No. 6,079,070, which is hereby incorporated by reference in its entirety.

FIG. 6 shows the cushioning section 12 and the first and second inflatable bladders 46, 48 pressurized so that the first surface 20 of the cushioning section 12 is level for normal resting of a user 52 thereon.

Referring to FIG. 7, for inclining the first surface 20 of the cushioning section 12 for assisting in turning the user 52 over, the first inflatable bladder 46 is deflated, while the second inflatable bladder 48 is inflated. Likewise, referring to FIG. 8, for inclining the first surface 20 of the cushioning section 12 to the other side for assisting in turning the user 52 over, the second inflatable bladder 48 is deflated, while the first inflatable bladder 46 is inflated.

The cushioning device 10 of the present invention is desirably made inexpensively to be disposed after each use. Such disposability eliminates the expense of cleaning and sanitizing the cushioning device 10 after each use. However, the cushioning device 10 made be manufactured to be reusable, if desired.

The use of the cushioning device 10 of the present invention will now be described in detail. In use, the cushioning device 10 is positioned on a support structure 38 and secured using straps 40, if present. The cushioning device 10 is then connected to an inflation device, such as a pump 42. The pump 42 is activated to inflate the cushioning section 12 and the restraint structures 18*a*, 18*b* or 18'. A user is then positioned on the cushioning section 12 and the cushioning device 10 is checked to confirm that it is not bottoming out. Alternatively, the user may be positioned on the cushioning section 12 prior to inflating the cushioning device 10. If present, bladders 46, 48 are activated to turn the user from side to side.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A cushioning device comprising:

an inflatable cushion having at least one side and first and second opposing surfaces, and at least one inflatable restraint structure attached to at least a portion of the at least one side of the inflatable cushion and is in fluid communication with the inflatable cushion;

wherein the pressure provided by the at least one restraint structure is greater than the pressure provided by the inflatable cushion.

2. The cushioning device according to claim 1, further comprising at least one non-inflatable restraint structure comprised of a foam material, foam beads, gel, or batting.

3. The cushioning device according to claim 1 comprising up to four restraint structures.

4. The cushioning device according to claim 1, wherein the pressure provided by the at least one restraint structure is from about 10 to about 20 mmHg greater than the pressure provided by the inflatable cushion.

5. The cushioning device according to claim 1, wherein at least one restraint structure extends beyond the first surface of the inflatable cushion.

6. The cushioning device according to claim 1, wherein the at least one restraint structure extends beyond the first and second opposing surfaces of the inflatable cushion.

7. The cushioning device according to claim 1, wherein the inflatable cushion comprises at least one inflatable bladder.

8. The cushioning device according to claim 1, wherein the inflatable cushion further comprises:

a plurality of micro-vents in the first surface of the inflatable cushion.

9. The cushioning device according to claim 1 further comprising:

a pressure sensing device operably connected to the inflatable cushion.

10. A cushioning system comprising:

an inflatable cushion having at least one side and first and second opposing surfaces;

at least one inflatable restraint structure attached to at least a portion of the at least one side of the inflatable cushion and is in fluid communication with the inflatable cushion; and an inflation device operably connected to the inflatable cushion wherein the pressure provided by the at least one restraint surface is greater than the pressure provided by the inflatable cushion.

11. The cushioning system according to claim 10, further comprising at least one non-inflatable restraint structure comprised of a foam material, foam beads, gel, or batting.

12. The cushioning system according to claim 10 comprising up to four restraint structures.

13. The cushioning system according to claim 10, wherein the pressure provided by the at least one restraint structure is from about 10 to about 20 mmHg greater than the pressure provided by the inflatable cushion.

14. The cushioning system according to claim 10, wherein the pressure provided by the at least one restraint structure extends beyond the first surface of the inflatable cushion.

15. The cushioning system according to claim 10, wherein the pressure provided by the at least one restraint structure extends beyond the first and second opposing surfaces of the inflatable cushion.

16. The cushioning system according to claim 10, wherein the inflatable cushion comprises at least one inflatable bladder.

17. The cushioning system according to claim 10, wherein the inflatable cushion comprises:

a plurality of micro-vents in the first surface of the inflatable cushion.

18. The cushioning system according to claim 10 further comprising:

a pressure sensing device operably connected to the inflatable cushion.

19. The cushioning system according to claim 10, wherein the inflation device is a pump.

20. The cushioning system according to claim 10 further comprising:

a support structure positioned adjacent and in contact with the second surface of the inflatable cushion.

21. A method for restraining a user on a cushioning device comprising:

positioning a cushioning device on a supporting structure, the cushioning device comprising an inflatable cushion having at least one side and first and second opposing surfaces, and at least one inflatable restraint structure attached to at least a portion of the at least on side of the inflatable cushion; and inflating the inflatable cushion and the at least one inflatable restraint structure is in fluid communication with the inflatable cushion and wherein the pressure provided by the at least one restraint surface is greater than the pressure provided by the inflatable cushion.

* * * * *